US006738316B2

(12) United States Patent
Gabathuler et al.

(10) Patent No.: US 6,738,316 B2
(45) Date of Patent: May 18, 2004

(54) TIMEPIECE DATE MECHANISM

(75) Inventors: Jacques Gabathuler, Conches (CH); Cédric Jacot, Morges (CH)

(73) Assignee: Rolex SA, Geneva (CH)

( * ) Notice: Subject to any disclaimer, the term of this patent is extended or adjusted under 35 U.S.C. 154(b) by 0 days.

(21) Appl. No.: 10/295,432

(22) Filed: Nov. 15, 2002

(65) Prior Publication Data

US 2003/0103416 A1 Jun. 5, 2003

(30) Foreign Application Priority Data

Nov. 30, 2001 (EP) ..... 01811165

(51) Int. Cl.[7] ..... G04B 19/20
(52) U.S. Cl. ..... 368/28; 368/37
(58) Field of Search ..... 368/28, 34–39

(56) References Cited

U.S. PATENT DOCUMENTS 3,779,001 A * 12/1973 Kocher et al. ..... 368/38
3,982,388 A * 9/1976 Guyot et al. ..... 368/35
4,257,113 A * 3/1981 Meister et al. ..... 368/35
6,574,167 B2 * 6/2003 Weissbach et al. ..... 368/35

FOREIGN PATENT DOCUMENTS

| | | |
|---|---|---|
| DE | 1523777 | 7/1969 |
| GB | 718896 | 11/1955 |

* cited by examiner

*Primary Examiner*—Vit W. Miska
(74) *Attorney, Agent, or Firm*—Sturm & Fix LLP

(57) ABSTRACT

This date mechanism comprises a units runner (1, 3) equipped with ten teeth or with a multiple of ten teeth and a tens runner (2, 4) equipped with four teeth or with a multiple of four teeth, a transmission connecting these runners to move the tens runner on by one step for every ten steps of the units runner (1, 3) and a drive runner (7, 8) for driving the units runner (1, 3). One tooth of the units runner (1, 3) for moving on from "1" to "2" is a tooth of an auxiliary runner (12) secured to the units runner (1, 3) and which is able to engage alternately with the teeth of the tens indicator runner (2, 4) and with a cam (15) secured to the tens runner (2, 4) and intended to allow the auxiliary runner (12) to drive said tens runner (4) by one step between "31" and "01" without driving the units runner (1, 3).

8 Claims, 12 Drawing Sheets

TIMEPIECE DATE MECHANISM

This timepiece date mechanism comprises a units indicator runner equipped with ten teeth or with a multiple of ten teeth and a tens indicator runner equipped with four teeth or with a multiple of four teeth, a transmission connecting the units and tens indicator runners to move the tens indicator runner on by one step for every ten steps of the units indicator runner and a drive runner for driving the units indicator runner, connected to the indicator geartrain of the timepiece.

The dates displayed in the windows of timepieces, particularly wristwatches, are often too small for many users. To overcome this disadvantage, it is possible either to use optical enlargement means or to distribute the numerals of the units and of the tens on the separate display runners so that the magnitude of the numerals is no longer dictated by a one-31st angular portion of the circumference of the display disk along which the numerals are distributed, allowing the numerals to be appreciably enlarged.

There are about four distinct types of mechanism allowing the numerals of the dates displayed to be enlarged.

The first type is represented by documents CH 310559, EP 529191, CH 698671 and EP 1070996. These are mechanisms formed of two disks, one for the tens the other for the units. These disks may be superposed, coaxial or located one on each side of the actuating device which comprises a 31-position wheel indexed by a jumper. This 31-position wheel bears two other wheels, one driving the units with 30 teeth, the 31st being replaced by a corresponding space, the other driving the tens has just four teeth distributed on a circumference of the same diameter as the thirty-one-tooth wheel.

This type of mechanism has several disadvantages. Either the display disks are side by side and two separate windows relatively spaced apart are needed in order not to see the crescent spaces between the edges of the disks, or these disks are superposed and the numerals of the tens and of the units appear at two different levels, which is not pretty and does not make for ease of reading.

This type of mechanism has three jumpers, which means that a relatively high torque is needed to drive the date, correspondingly reducing the torque transmitted to the escapement.

When the drive device has a 31-toothed runner, this occupies a great deal of surface area.

In a second type of mechanism described in CH 324270, FR 2240474 and CH 689601, it has been proposed for only the units disk to be driven, the latter bearing a finger which drives the tens indicator every ten steps.

The disadvantage with this system is that it is necessary to have a 31-position units disk, failing which a significant correction has to be made at the end of each month.

This units disk must be as large as a normal date disk and, in spite of that, the size of the numerals will be limited. This system also entails the date being located at the six o'clock or noon position. This is because, if it is desired for the numerals to be relatively large, it is necessary for them to be oriented radially, which means that they would be lying on their sides if they were to be appear through a window arranged at three o'clock. Finally, in this case the disks are also superposed.

DE 29702749 U1 proposes a very simple display comprising two superposed disks, the upper disk of which comprises the dates from 1 to 15 plus a space, equivalent to an angular space of one date separating the 1 from the 15, in which a window is pierced to reveal the lower disk which bears the dates from 16 to 31. The two disks are actuated in succession, the upper disk by 16 steps, then the lower disk the numerals of which are visible through the window in the upper disk.

The control mechanism is relatively complicated and the display is on two levels, with the aforesaid disadvantages.

The last type of mechanism is illustrated by CH 578202 and CH 690515. It uses two disks which are controlled by Maltese crosses and levers which make this mechanism relatively difficult to adjust.

The object of the present invention is to resolve the drawbacks of the abovementioned solutions, at least in part.

To this end, the subject of the present invention is a date mechanism for a timepiece, as claimed in claim 1.

This mechanism has several advantages, among which mention may be made of the small number of parts, the absence of levers, the presence of just two jumpers, which work together only every ten days, thus reducing the loss of energy from the movement.

The space occupied by this mechanism is small, particularly in terms of surface area, in that it does not use a thirty-one-tooth drive wheel.

All the components of the mechanism can be made by cutting by generation, which is a manufacturing process that makes it possible to obtain very precise geometries with very good surface finishes, which guarantee very good efficiency in the transmission of force in the mechanism.

This makes it possible as a preference to have a mechanism made entirely of circular toothed members with central axes of rotation, something which presents a great advantage, particularly when a date correction is made at around about midnight. The date mechanism can then move in both directions of rotation of these toothed members without any risk of damage or jamming, as may occur with lever-type systems.

Advantageously, the units and tens runners consist of concentric coplanar disks which means that the space between these two disks can be small and of constant width in order not to have to be hidden, allowing the units and the tens numerals to be displayed in a single window.

Bearing in mind the small number of parts and therefore the small bulk of the mechanism, the latter may advantageously be placed entirely under the units and tens indicator disks.

Advantageously, the units disk may have just ten numerals. This disk may be of small size, although the numerals it bears may have a size very much greater than that of a conventional 31-date disk, especially if this disk is coaxial with the center of the movement.

Other advantages will become apparent in the course of the description which will follow. The drawings appended to this description illustrate, schematically and by way of example, one embodiment and an alternative form of the timepiece date mechanism that is the subject of the present invention.

Figure 1:
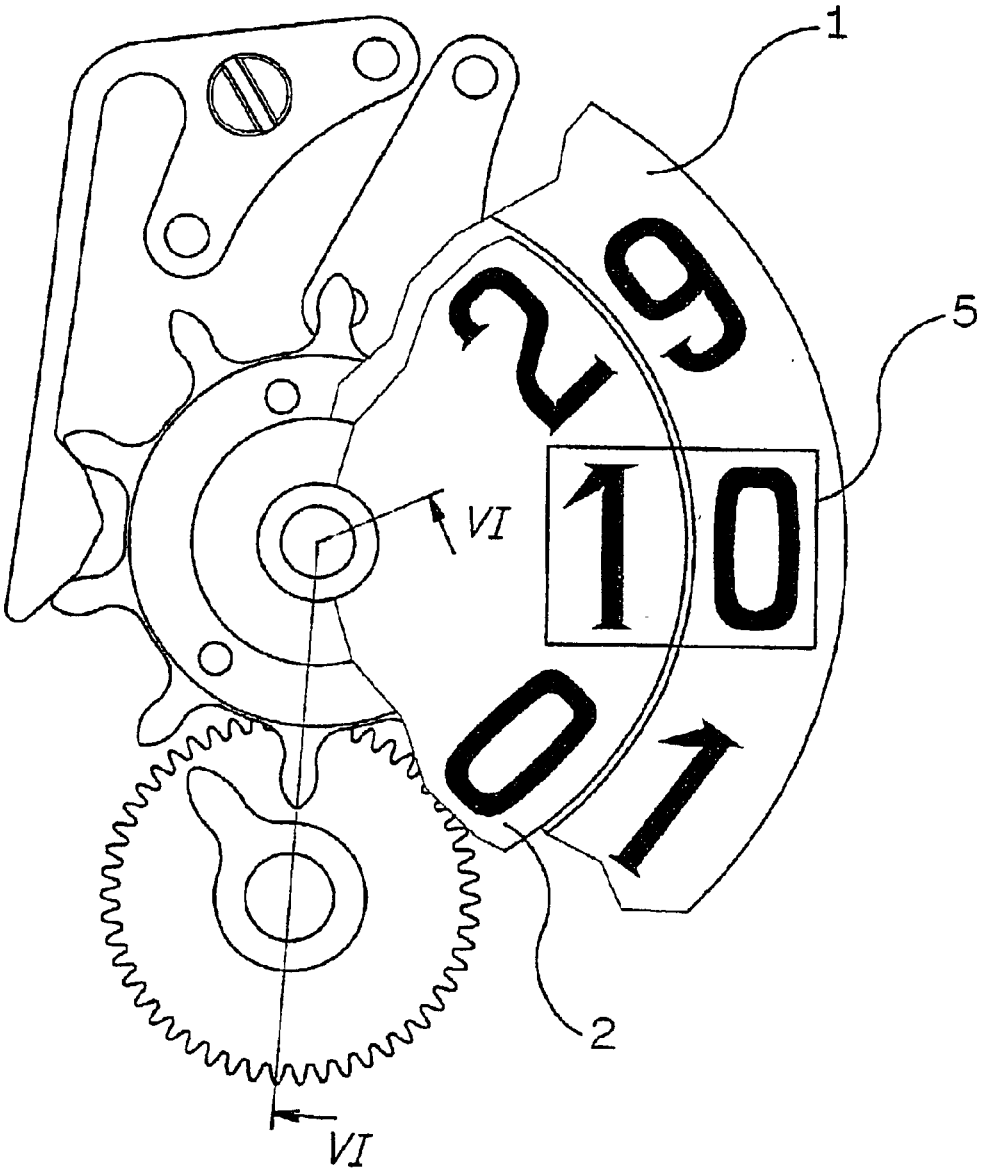
FIG. 1 is a view from above of this mechanism with partial cut away of the units and tens disks.

The date mechanism illustrated by FIG. 1 comprises two disks, a units disk 1 bearing ten numerals or a multiple of ten numerals intended to display the units, a tens disk 2 bearing four numerals or a multiple of four numerals intended to display the tens. The numeral "0" on the tens disk 2 may be omitted and replaced by a blank space. The two disks 1 and 2 are concentric and allow the units and tens numerals to be displayed through a single window 5.

Figure 6:
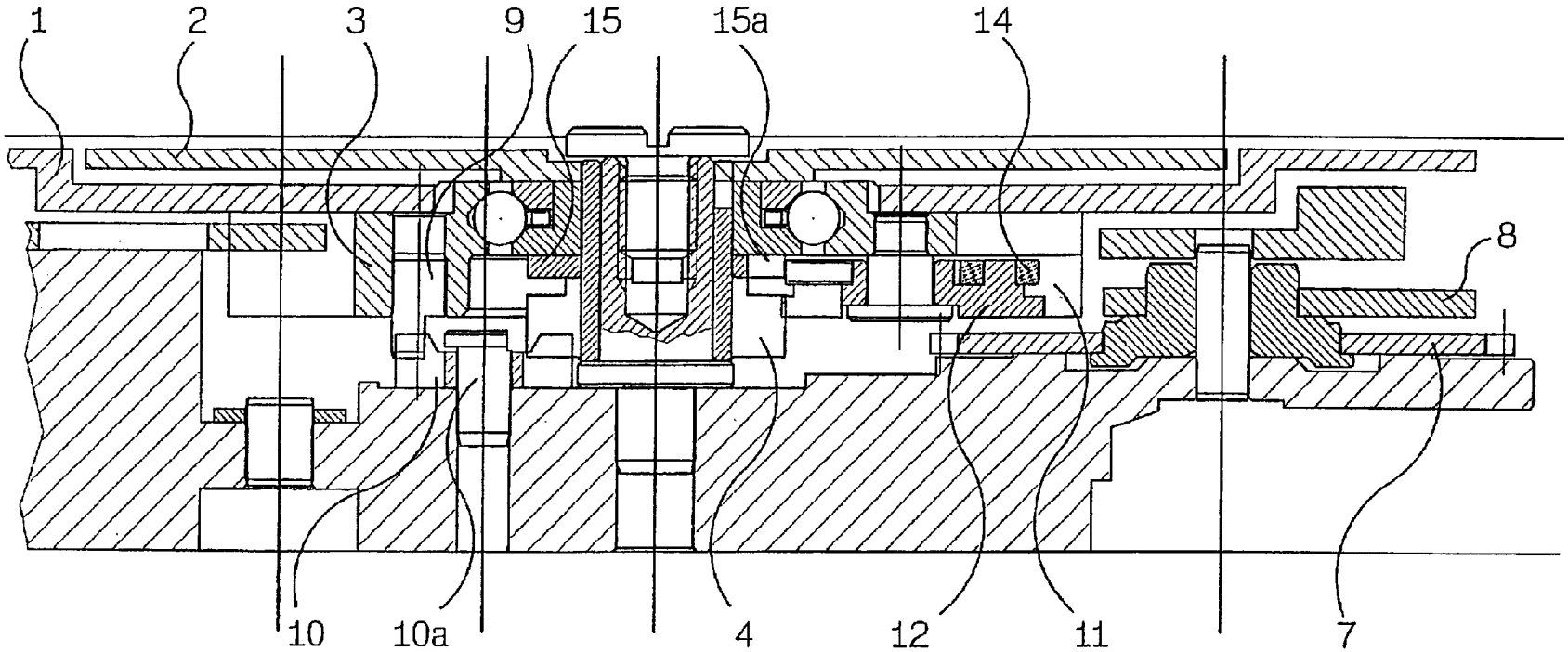
FIG. 6 is a view in section on VI—VI of FIG. 1.
Figure 7:
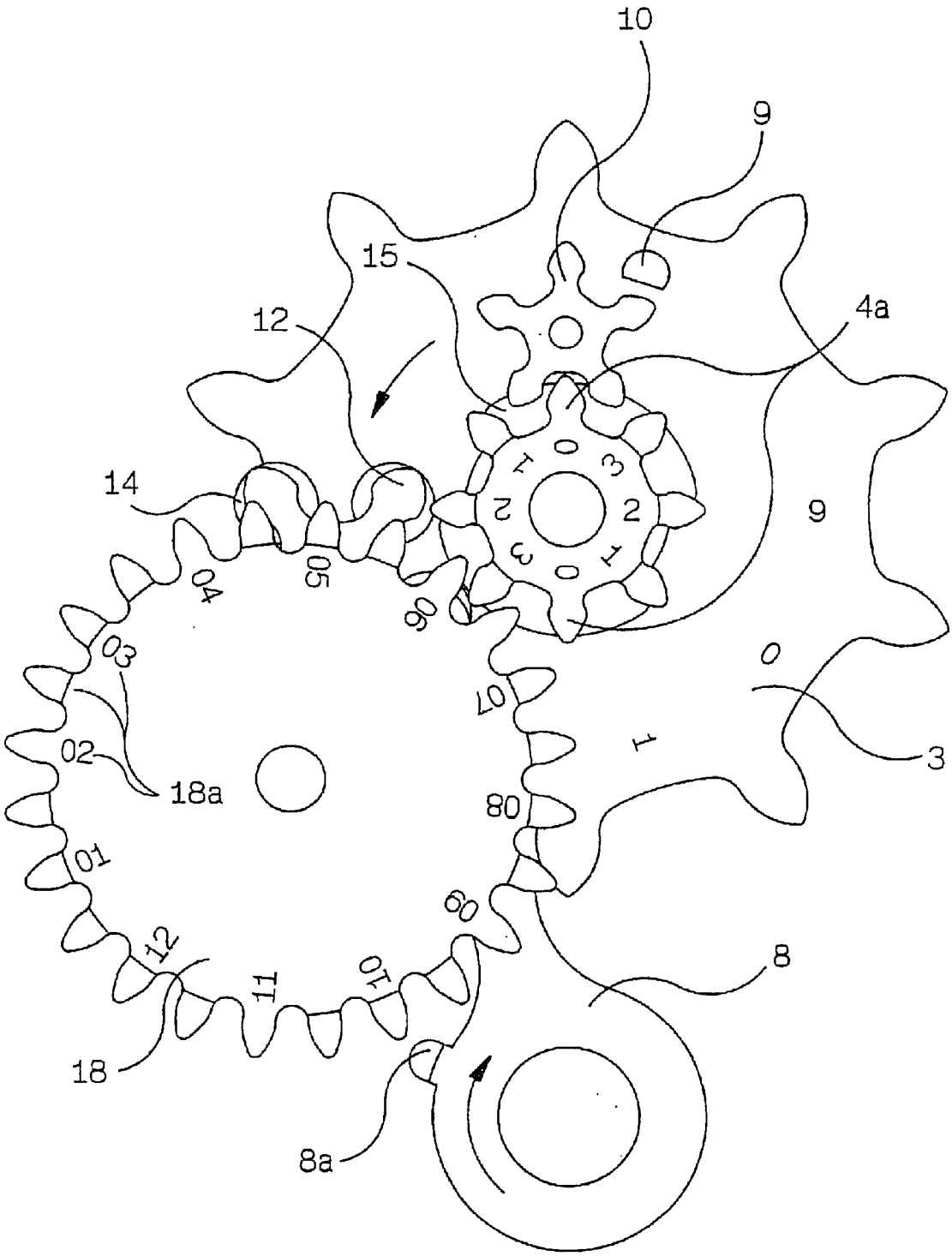
FIGS. 7 to 10 are views of an alternative form of the date mechanism of FIGS. 1 to 6 illustrating an annual date mechanism showing the positions of the runners of this alternative form during the successive moving-on of the dates ranging from "29" to "01" at the end of a thirty-one-day month.
Figure 8:
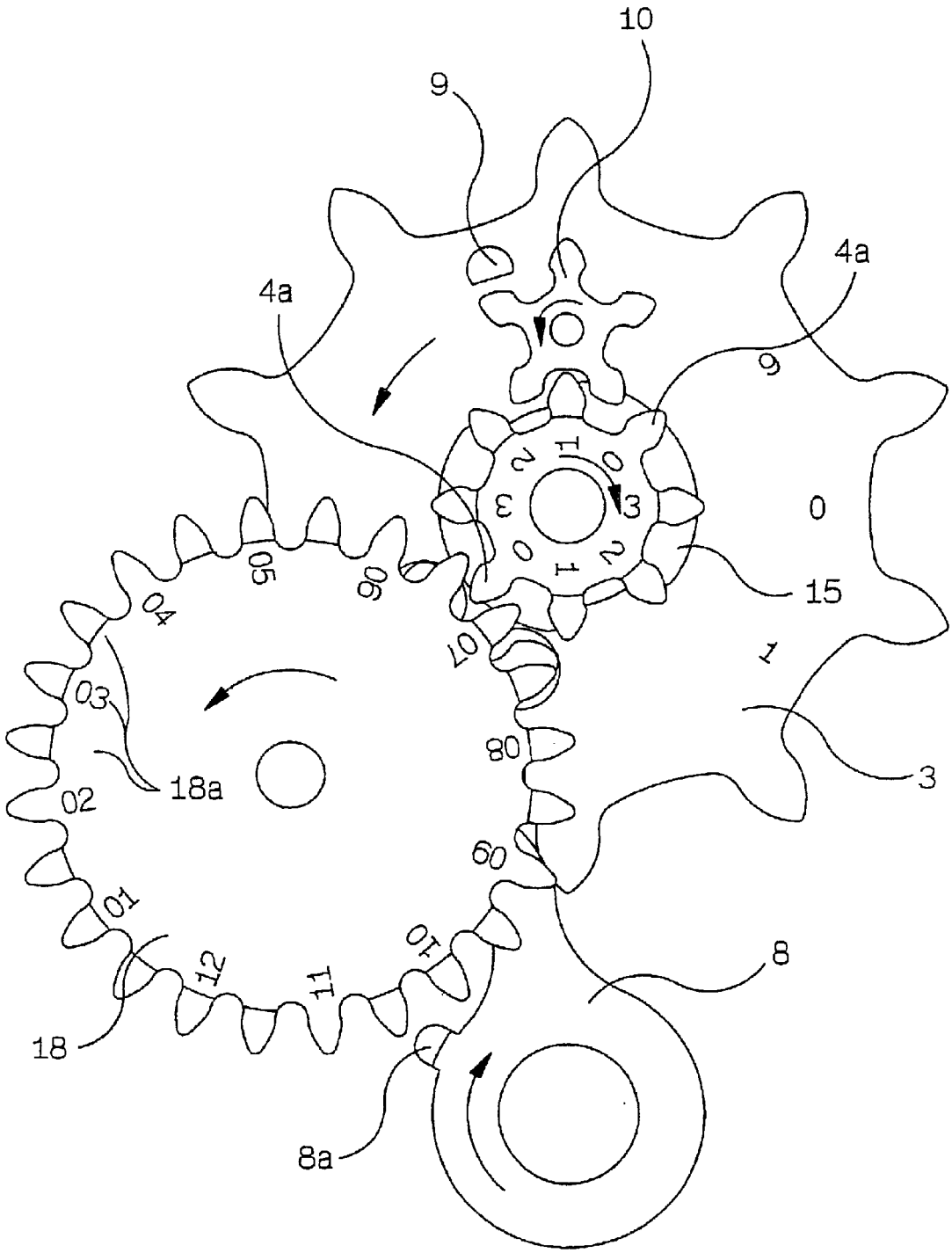
Figure 9:
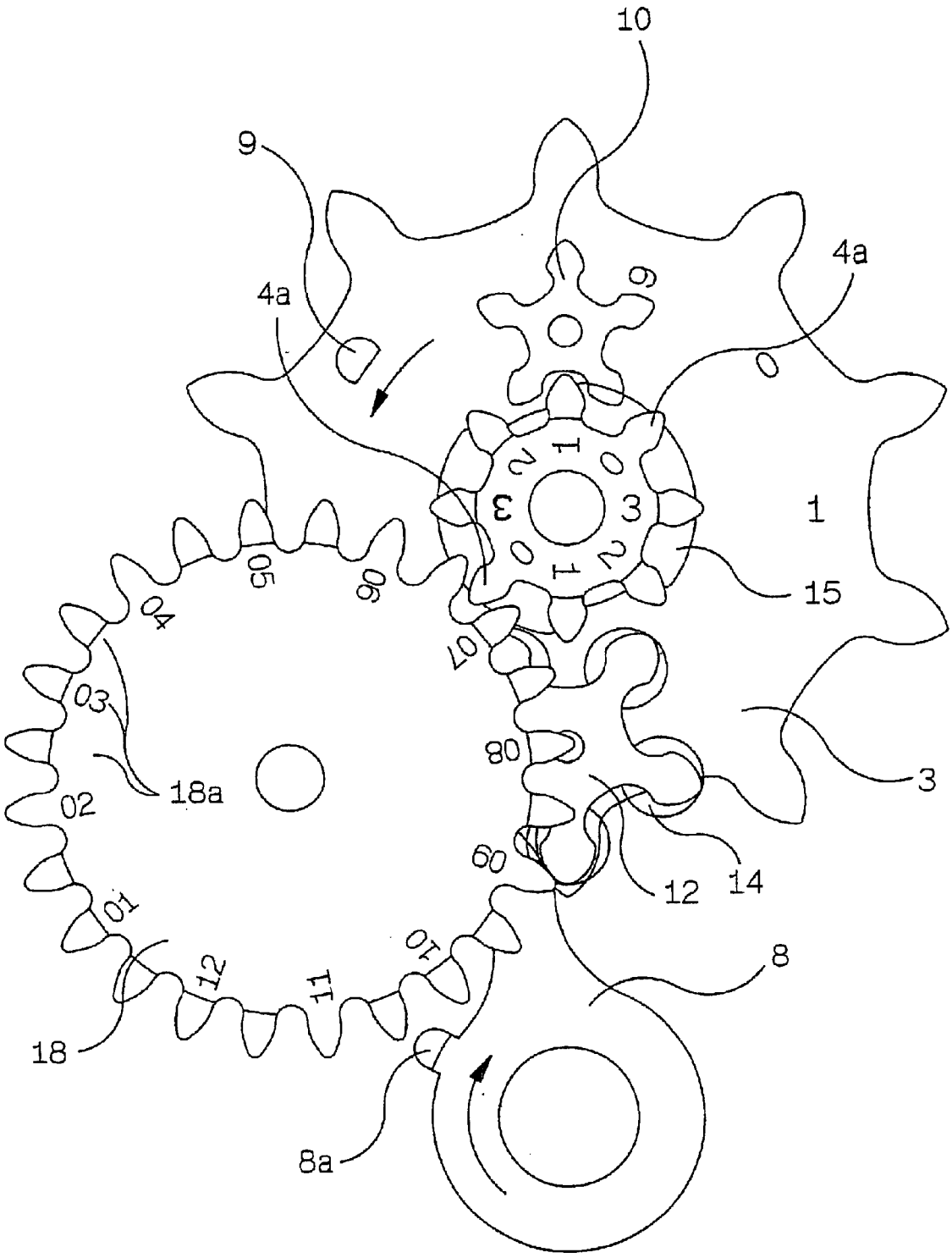

The units disk 1 is secured to a units toothed wheel 3 which has 10 teeth or a multiple of ten. The tens disk 2 is secured to a tens pinion 4 (FIG. 2) which has four teeth or a multiple of four. The tens pinion 4 and the units wheel 3 are concentric, the pinion 4 being partially housed in a circular cutout formed at the center of the units wheel 3. The surfaces of the two disks 1, 2 bearing the date numerals are coplanar, as can be appreciated from FIG. 6.

The units wheel 3 is connected to the hours wheel of the time indicator geartrain (not depicted) which performs two revolutions in 24 hours via an intermediate wheel which drives a calendar wheel 7 at a rate of one revolution in 24 hours. This calendar wheel 7 bears a date finger 8 which drives the units wheel 3 by one step every 24 hours.

An intermediate wheel 10 borne by a tenon 10*a* secured to the mounting plate of the timepiece meshes with the tens pinion 4. This intermediate wheel 10 lies in the path of a pin 9 borne by the units wheel 3, so that the intermediate wheel 10 is driven by one step for every revolution of the units wheel 3 and itself drives the tens pinion 4, also by one step. The driving of the tens pinion 4 coincides with the moving of the units disk 1 from "9" to "0".

In order to avoid having to carry out substantial correction after the "31", by passing step by step through "32", "33" and so on until "01" is rearrived at, the units wheel 3 bears an auxiliary runner consisting of a month-end pinion 12, one tooth of which is positioned by a cam 15 secured to the tens pinion 4 in the place of a hollowed-out tooth 11 of the units wheel 3. Each tooth of the month-end pinion 12 is associated with a dual-pivoting roller 14. These rollers 14 lie at the height of the cam 15, so that these rollers 14 roll along the cam 15, thus reducing friction between this cam 15 and the month-end pinion 12 to a minimum.

The cam 15 has a cut-out 15*a* situated between two teeth of the tens pinion 4, corresponding to the movement from the numeral "3" to the numeral "0" on the tens disk 2. By virtue of this cam 15 and of its cutout 15*a*, the month-end pinion is angularly immobilized with respect to the units wheel 3 when the tens numerals change as long as a portion of cam 15 intersects the part of a roller 14, something which occurs during the tens changes, except during the change from the "31" to "01", which corresponds to the recess 15*a* in the cam 15, which means that in this case, the month-end pinion 12 can rotate by one step, the units wheel 3 remaining immobile. In consequence, the tens disk moves on from "3" to "0", while the units disk remains on the numeral "1", which corresponds to the units numeral, for the dates "31" and "01".

Two positioning jumpers 16 and 17 collaborate one with the units wheel 3 and the other with the tens pinion 4. As can be seen from the figures, the jumper 16 of the units wheel 3, which is thicker, can develop a higher torque than the jumper 17. This allows the units wheel 3 to be held immobile when the tens disk moves on from "3" to "0" between the "31" and the "01".

Figure 2:
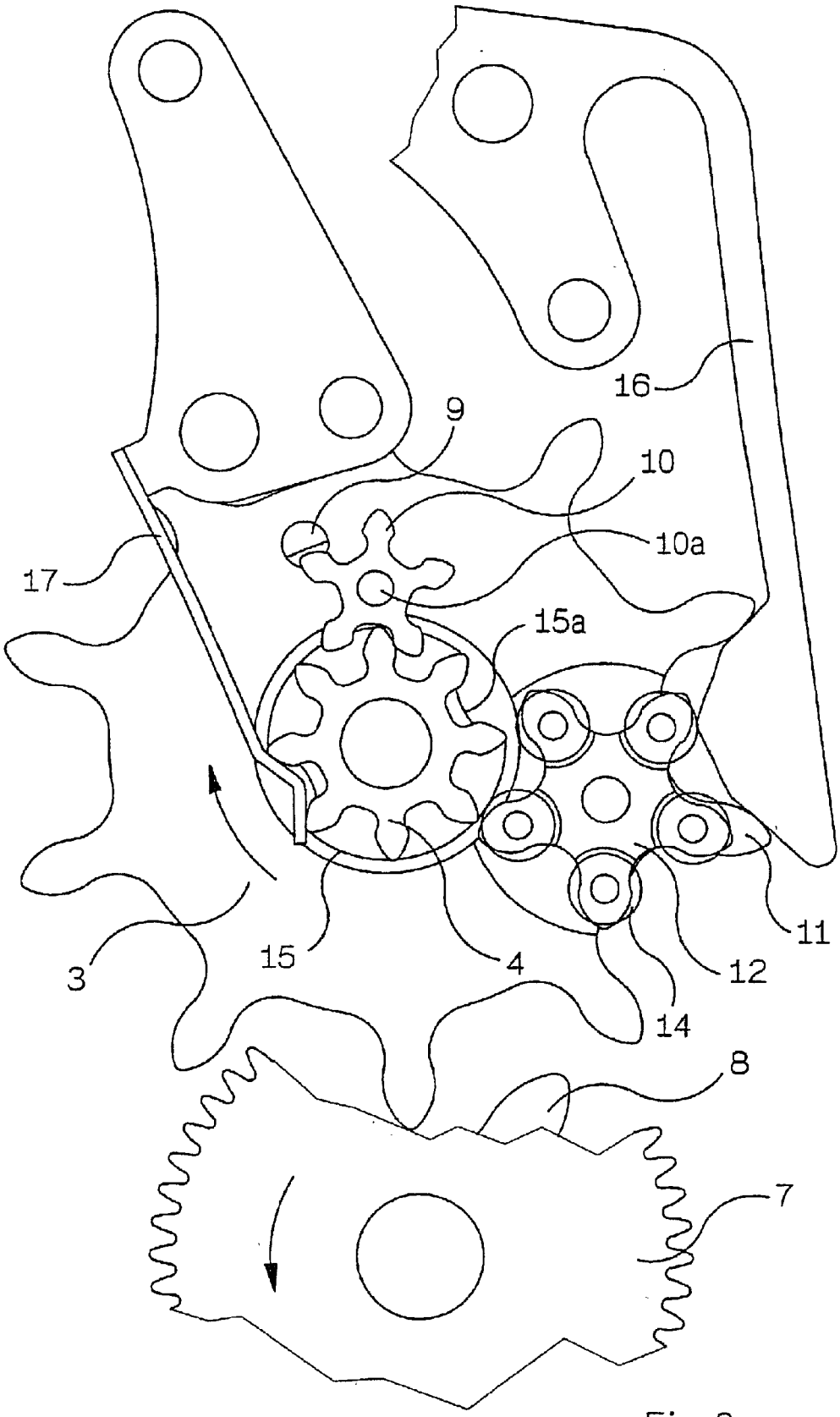
FIG. 2 is a view from beneath of FIG. 1 showing the mechanism when it displays "29"
Figure 3:
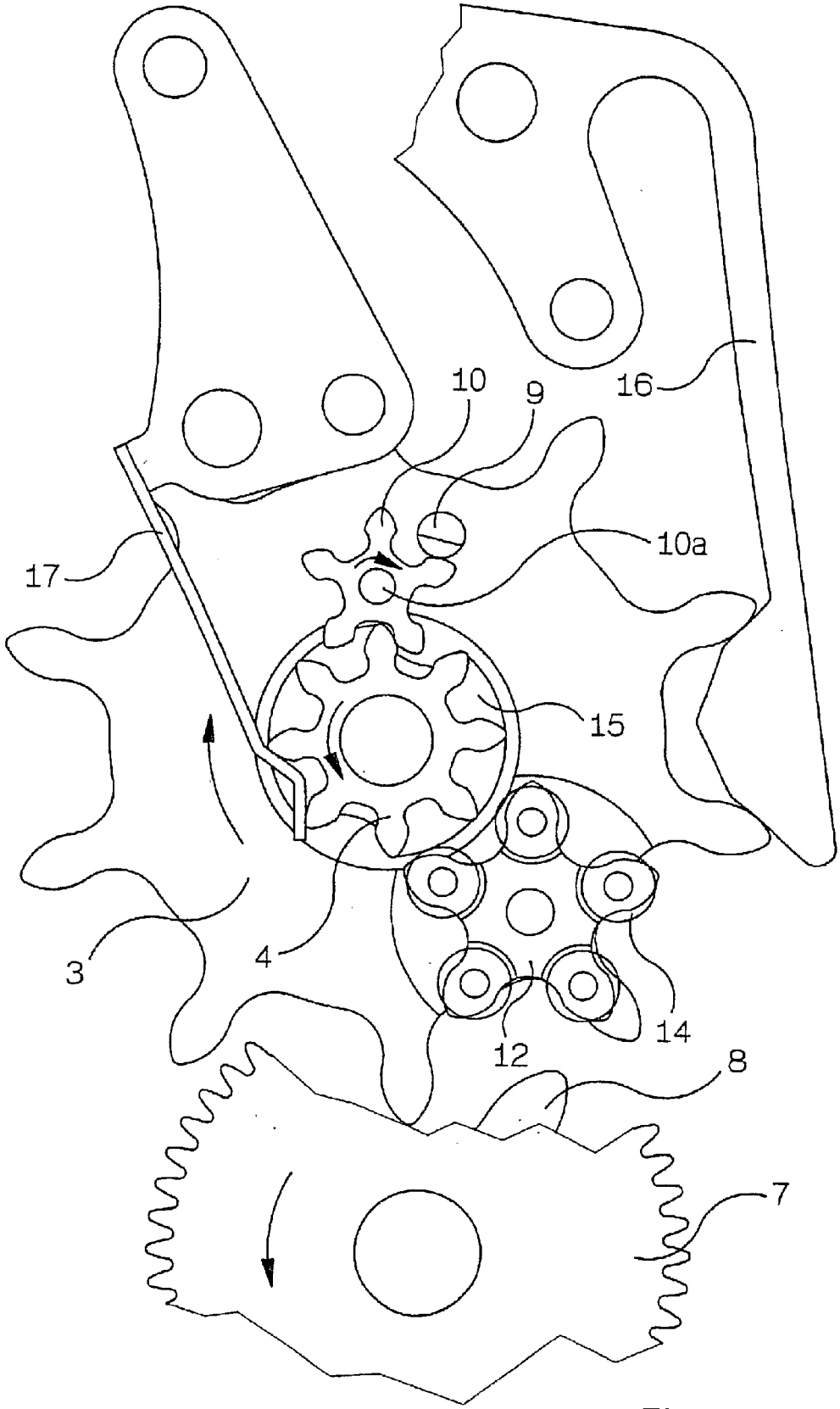
FIG. 3 is a view similar to FIG. 2 showing this mechanism at the end of the moving-on to "30"

FIG. 3 shows the date mechanism when the units 1 and tens 2 disks display "30", that is to say that the pin 9 secured to the units wheel 3 rotating in the direction of the arrow situated on this wheel 3 has just caused the intermediate wheel 10 and the tens pinion 4 to advance by one step in the direction of their respective arrows, to move on from the position of FIG. 2 of that of FIG. 3.

Figure 4:
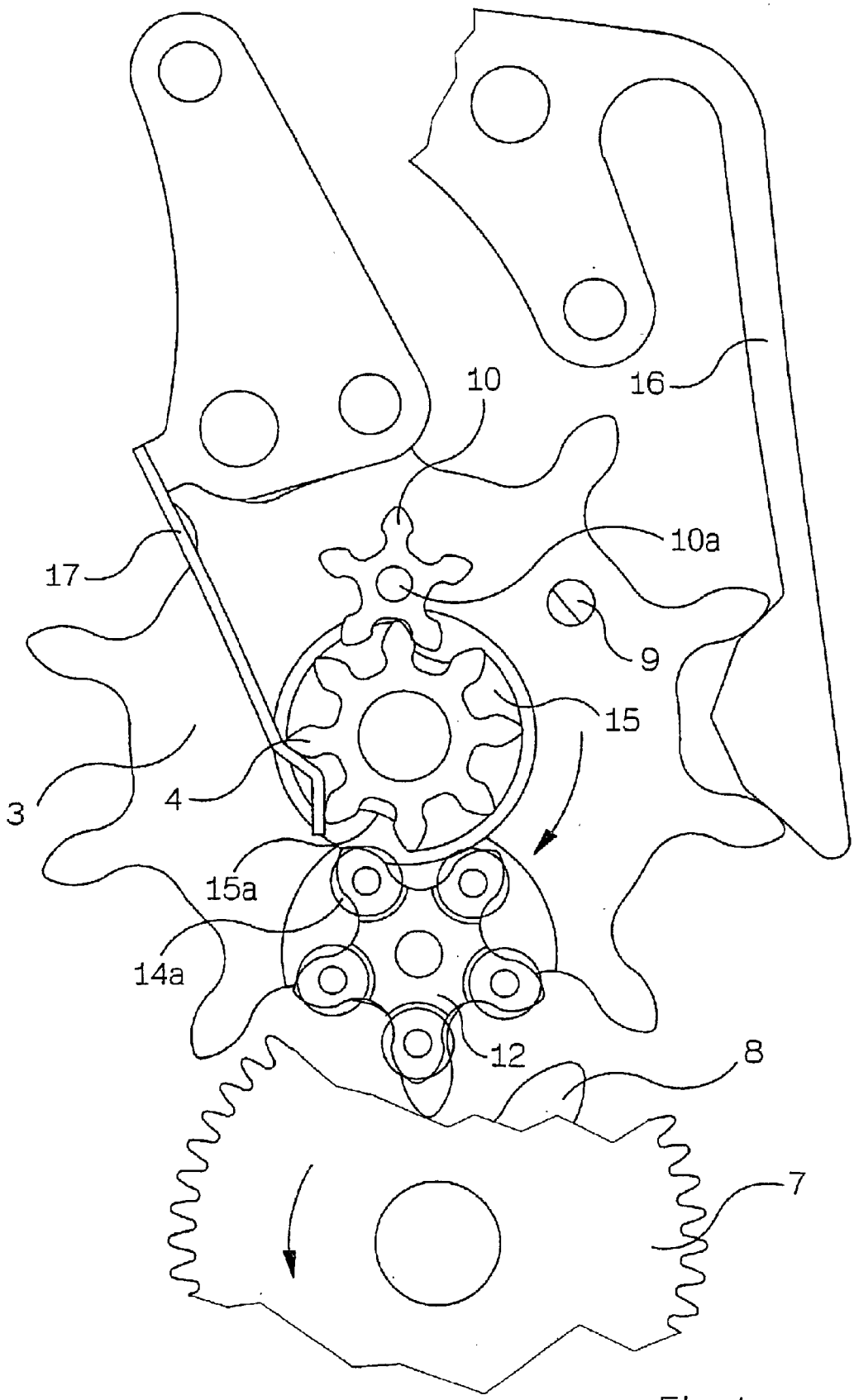
FIG. 4 is a view similar to FIG. 2 at the end of the moving-on to "31"
Figure 5:
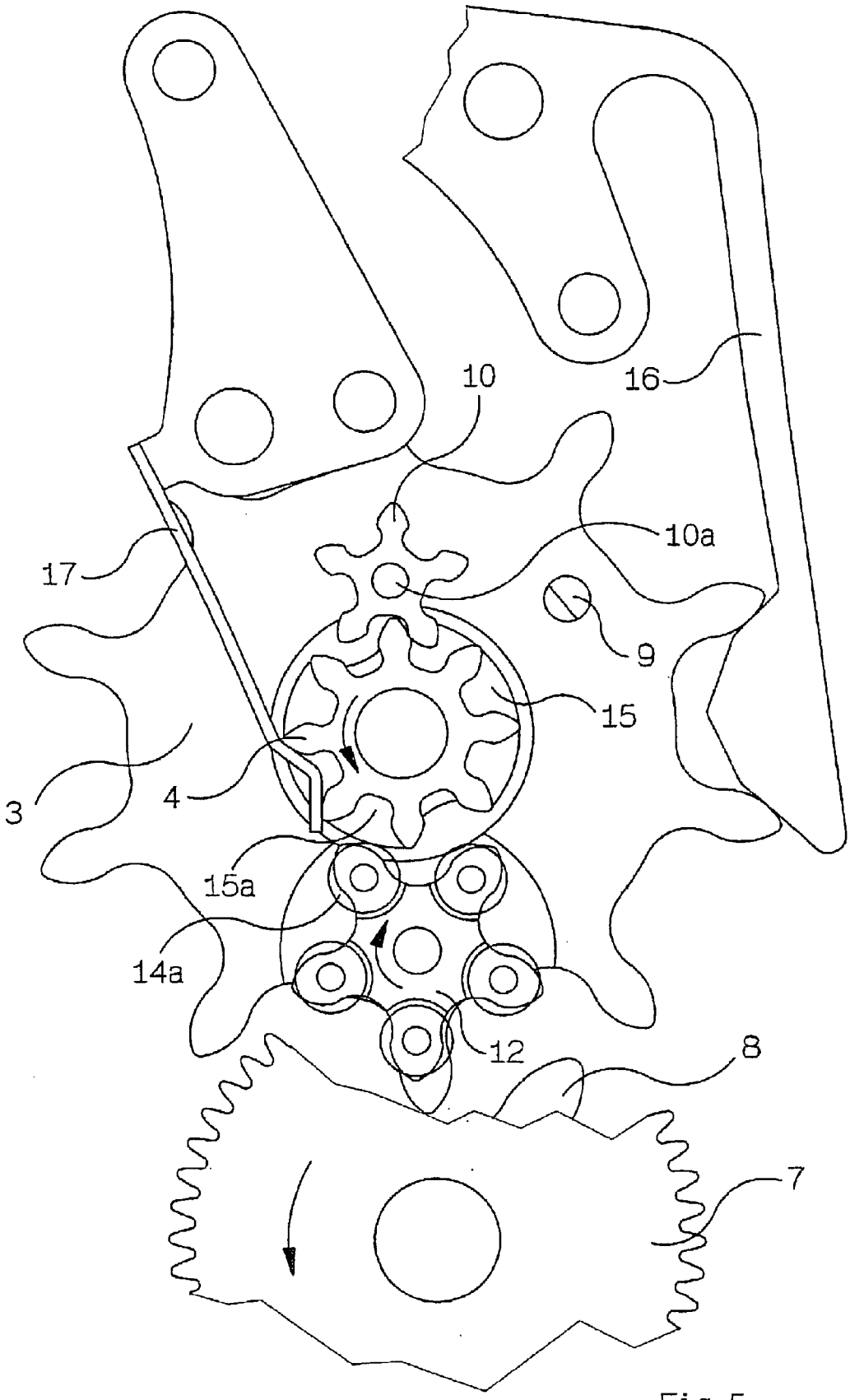
FIG. 5 is a view similar to FIG. 2 at the end of the moving-on to "01"

FIG. 4 shows the position of the runners of the date mechanism when the two disks 1, 2 are displaying "31". It may be seen that, in this position, a roller 14*a* of the month-end pinion 12 faces the recess 15*a* of the cam 15. Thus, in moving on from the position of FIG. 4 to that of FIG. 5, the date finger 8 can then rotate the month-end pinion 12 by one step. As this pinion is no longer immobilized by the cam 15, the units wheel 3 therefore remains immobile. By virtue of this month-end pinion and of the cam 15, the date can be moved on directly from "31" to "01".

As can be seen, whereas hitherto the date mechanisms in which the units and tens are displayed by two separate disks have had the essential, if not sole, goal of being able to enlarge the date numerals, the present invention shows that it is possible to gain another benefit from this type of mechanism for reducing corrections. Indeed, it may be seen from the foregoing description that this display system makes it possible to move on from "31" to "01" without causing the units disk to move, causing movement only of the tens disk.

FIGS. 7 to 11 show how this feature of the date mechanism described hitherto can be put to advantage in obtaining an annual date based on a novel concept whereby the date display changes entirely automatically from 01.03 to 28 or 29.02 of the next year, without either one of the disks or both of the two disks simultaneously ever moving by more than one step in 24 hours. As was seen earlier, the basic mechanism described earlier already allows the movement from "31" to "01" by changing only the tens disk by one step and by holding the units disk 1 immobile. All that is then required is to find a means of moving the two disks simultaneously by one step to move on from "30" to "01" and we shall then have a very simple annual date capable of implementing this clever date-change method and having all the advantages listed earlier.

This result is obtained by a method which consists in forming, in addition to the driveline which daily connects the clock movement with the units wheel 3 and, for every ten steps of the latter, to the tens pinion 4, via the peg 9 secured to this units wheel 3 and via the intermediate wheel 10, an annual driveline which connects the clock movement directly to the tens pinion 4 and is programmed to drive the latter by one step at the same time as the units wheel 3 to move on from "30" to "01" at the end of the thirty-day months. This date mechanism is identical to the previous one except that it comprises an additional annual wheel 18 making it possible to form the annual driveline and except that the date finger 8 bears a stud 8*a* intended selectively to drive the annual wheel as will be explained hereinafter.

The annual wheel 18 has twenty-four teeth, namely two per month. Some of these teeth are thinned on the outside of a circular arc 18*a* concentric with the axis of this annual wheel 18, and others are not. The thickness of the thinned teeth of the annual wheel 18 is therefore reduced so as to allow these teeth to pass under the stud 8*a* of the date finger. The thickness of the two teeth 4*a* of the tens pinion 4 corresponding to numeral "0" extends over the entire thickness of the teeth of the annual wheel 18 so that these teeth are in a position to mesh with the teeth and the tens pinion 4. By contrast, the thickness of the other teeth of this tens pinion is reduced so that they do not meet the teeth of the annual wheel 18.

The teeth of the annual wheel 18 which are not thinned, are five in number and correspond to the five months of the year which have fewer than 31 days. In the figures relating to this annual date, every second tooth of the annual wheel is numbered according to the month of the year to which it and the tooth next to it corresponds, from 01 to January to 12 for December. As can be seen by virtue of this numbering, the un-thinned teeth of the annual wheel 16 correspond therefore to the months of February, April, June, September and November.

Figure 10:
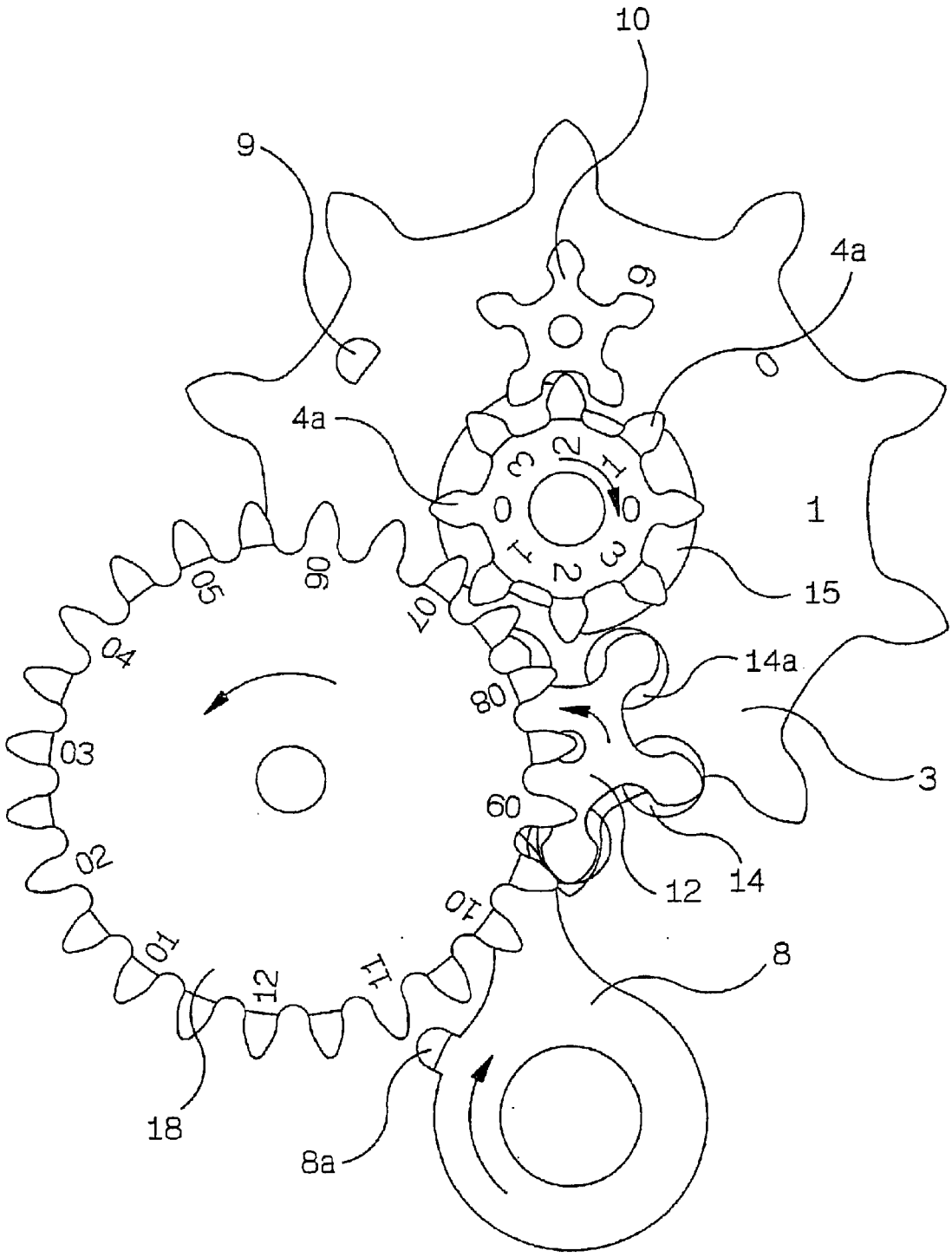

In order to understand how this annual date works, we shall first of all describe below, with the aid of FIGS. 7 to 10, the way in which this date mechanism works between 29.10 and 01.11, that is to say when moving on from the end of a 31-day month to the $1^{st}$ of the next month, then we shall describe, with the aid of FIGS. 10 and 11, how this date mechanism works between 30.11 and 01.12, that is to say when moving on from the end of a thirty-day month to the $1^{st}$ of the next month.

If we look at the position of the runners of the date mechanism between 29.10 and 30.10 (FIGS. 7 and 8), we see that the date finger 8 has driven the units wheel 3 by one step and that the latter wheel has in turn driven the tens pinion 4, using the pin 9. Given that the tooth of the tens pinion 4 which meshes with the annual wheel 18 is the tooth "0" which is shaped to mesh with all the teeth of the annual wheel 18, the annual wheel is driven by one step.

To move on from 30.10 to 31.10 (FIGS. 8 and 9), the date finger 8 drives the units 3 by one step. The annual wheel 18 does not move the tooth corresponding to the month "10" as it is a thinned tooth which passes under the stud 8*a* of the date finger 8. It can also be seen that the next tooth on the units wheel 3 which will come into mesh with the date finger is in actual fact a tooth of the month-end pinion 12. Now, in the position illustrated by FIG. 9 and which corresponds to 31.10, it can be seen that, when the date finger 8 drives the tooth of this month-end pinion 12, this pinion is no longer prevented from turning by the cam 15, given that the roller 14 which normally butts against this cam 15 is facing a recess 15*a* in this cam.

The month-end pinion 12 can therefore rotate on itself without driving the units wheel 3, but by contrast driving the tens pinion 4 by one step, the tooth "0" of this pinion 4 engaged in the teeth of the annual wheel 18 once again driving this wheel 18 by one step. Thus, the date which previously displayed "31" has changed only the tens numeral, the units numeral having remained immobile, and the next date is therefore "01".

Figure 11:
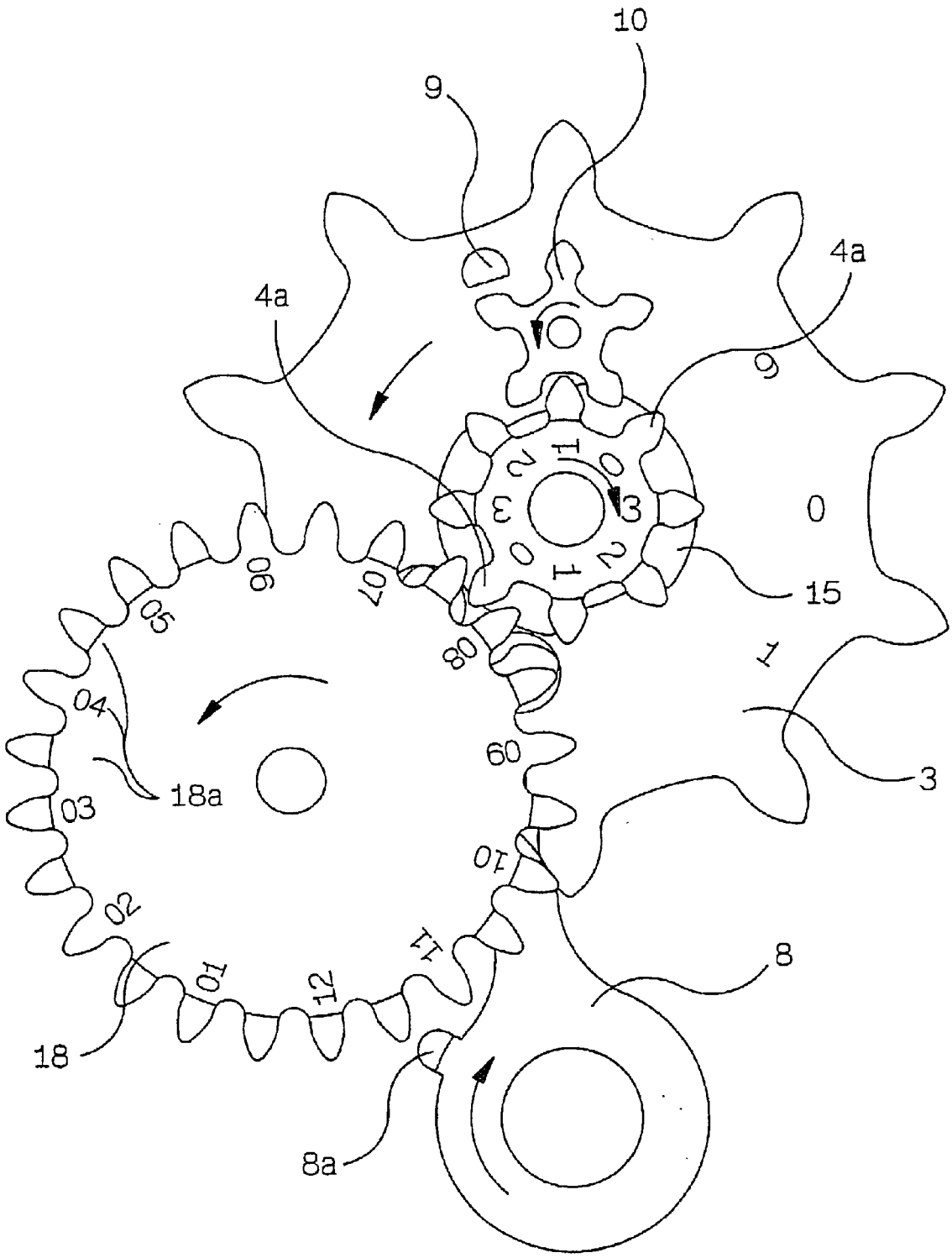
FIGS. 11 and 12 illustrate the positions of the runners of this alternative form when the date moves on from "30" to "01".
Figure 12:
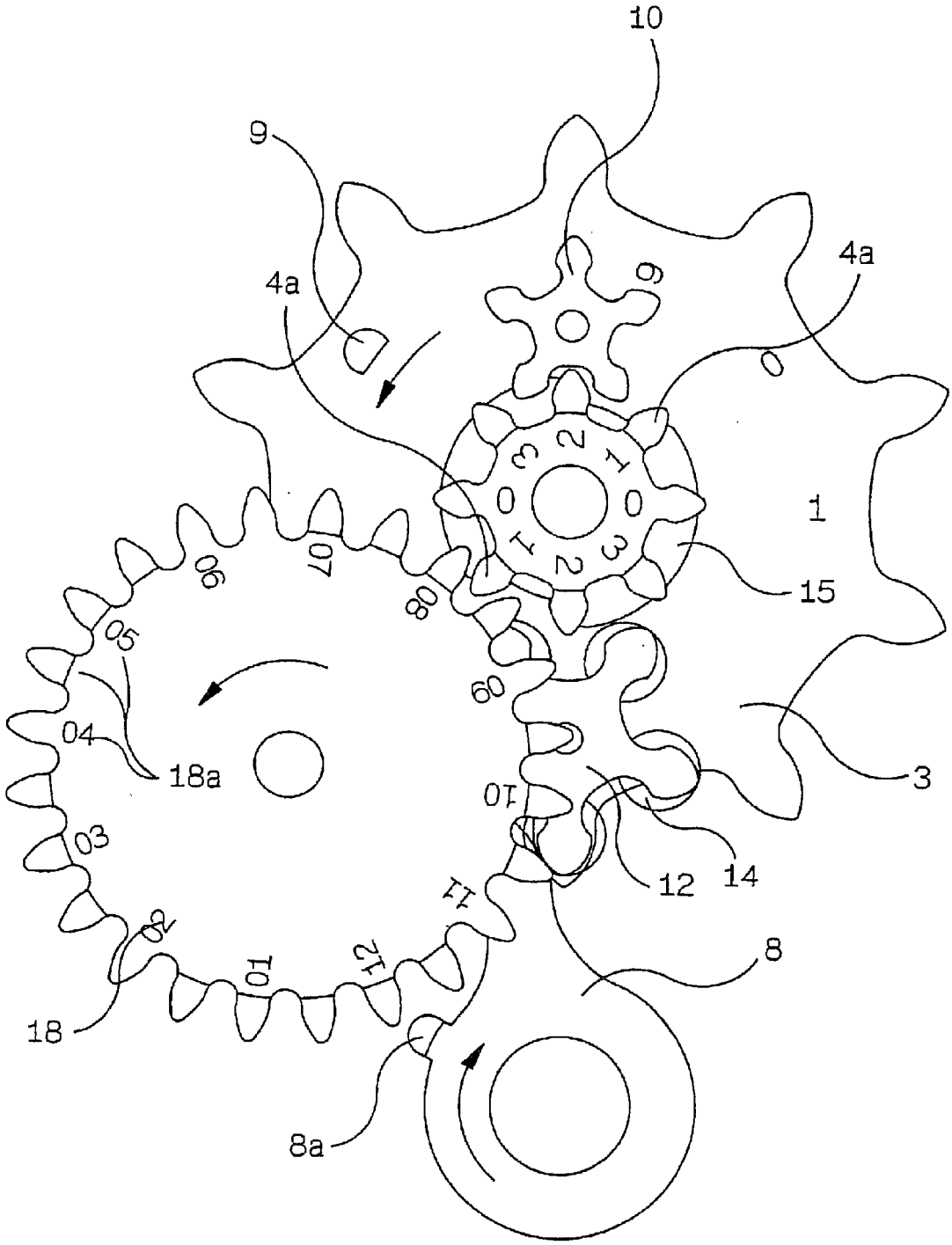

We shall refer to FIGS. 11 and 12 to see how to move on directly from "30" to "01", assuming that the tooth of the annual wheel which is in the path of the stud 8*a* is the tooth "11" corresponding to the end of the month of November. It is then with one of the five teeth of the annual wheel that the stud 8*a* is able to come into mesh.

When the date finger 8 turns from the position illustrated in FIG. 11 to move on to the position illustrated in FIG. 12, it drives the units wheel 3 by one step while the stud 8*a* at the same time drives the annual wheel 18 by one step also. Given that the tooth of the tens pinion 4 which is engaged in the teeth of the annual wheel corresponds to a tooth "0" shaped to mesh with all the teeth of the annual wheel 18, this tens pinion is therefore driven by one step by the annual wheel 18. Thus, the units numeral which was "0" moves on to "1" and the tens numeral which was "3" moves on to "0".

The date mechanism described hereinabove therefore allows movement automatically and without any correction from 01.03 to 28 or 29.02 of the next year.

What is claimed is:

1. A timepiece date mechanism comprising a units indicator runner equipped with ten teeth or with a multiple of ten teeth and a tens indicator runner equipped with four teeth or with a multiple of four teeth, a transmission connecting the units and tens indicator runners to move the latter runner on by one step for every ten steps of the units indicator runner and a drive runner for driving the units indicator runner, connected to the indicator geartrain of the timepiece, wherein one tooth of the units indicator runner for moving on from "1" to "2" is a tooth of an auxiliary runner the rotation spindle of which is secured to the units indicator runner and is able to engage alternately with the teeth of the tens indicator runner and with a cam coaxial with and secured to this tens indicator runner, this cam comprising, on the one hand, at least one part for angularly immobilizing said auxiliary runner and, on the other hand, at least one cut-out the position of which is chosen to allow said auxiliary runner to drive said tens indicator runner by one step between "31" and "01" without driving the units indicator runner.

2. The date mechanism as claimed in claim 1, in which said tens runner is also selectively in engagement with an annual runner itself selectively in engagement with said drive runner for driving the units indicator runner, and said annual runner and said tens runner being shaped to engage, when the indicator runner moves the tens on from "2" to "3" and from "3" to "0", said drive runner for driving the units indicator runner being shaped to engage with said annual runner only when a date moves on directly from "30" to "10".

3. The date mechanism as claimed in claim 1, in which the units runner and the tens runner are concentric and each carry a display disk, the surfaces of the two disks bearing the date numerals being coplanar.

4. The date mechanism as claimed in claim 1, in which all the runners are circular toothed members with a central axis of rotation.

5. The date mechanism as claimed in claim 1, in which the rubbing surfaces of said auxiliary runner with said cam consist of pivoting rollers associated with each tooth of said auxiliary runner.

6. The date mechanism as claimed in claim 1, in which said auxiliary runner is housed at least partly in a housing formed in the units wheel.

7. The date mechanism as claimed in claim 2, in which the selective engagement between the annual runner and, on the one hand, the tens runner and, on the other hand, the drive runner, is obtained by means of teeth of different thicknesses situated at different levels.

8. The date mechanism as claimed in claim 1, in which the tens and units numerals appear in a single window.

* * * * *